United States Patent [19]

Burton et al.

[11] 4,151,980

[45] May 1, 1979

[54] WINCH

[75] Inventors: John D. Burton; Richard D. J. Huggett, both of Horndean, England

[73] Assignee: Lewmar Marine Limited, Hampshire, England

[21] Appl. No.: 843,934

[22] Filed: Oct. 20, 1977

[30] Foreign Application Priority Data

Nov. 26, 1976 [GB] United Kingdom ..... 49515/76
Apr. 26, 1977 [GB] United Kingdom ..... 17377/77

[51] Int. Cl.[2] ..... B66D 1/30

[52] U.S. Cl. ..... 254/150 R; 254/175.7; 24/132 R

[58] Field of Search ..... 254/150 R, 138, 175.7, 254/175.5, 191, 134.3; 114/218; 24/132 R, 115 R, 127; 226/181, 182, 184; 74/230.24

[56] References Cited

U.S. PATENT DOCUMENTS

| | | | |
|---|---|---|---|
| 3,343,809 | 9/1967 | Newell | 254/134.3 |
| 3,448,962 | 6/1969 | Miller | 254/175.7 |
| 3,985,340 | 10/1976 | Guangorence | 254/150 R |
| 4,054,265 | 10/1977 | Magg et al. | 254/138 |

FOREIGN PATENT DOCUMENTS

| | | | |
|---|---|---|---|
| 1010686 | 11/1965 | United Kingdom | 24/132 R |

*Primary Examiner*—Trygve M. Blix
*Assistant Examiner*—Kenneth W. Noland

[57] ABSTRACT

The jaws of a self-tailing channel of a winch are each provided with teeth in the form of ribs or ridges, the teeth being on a skew and being staggered so that a tooth on one of the jaws is not opposite to a tooth on the other of the jaws. In the embodiments shown the teeth are staggered by half their pitch; in one embodiment the teeth are straight and skewed and in another are arcs on a center of curvature spaced from the central axis of the jaw. This disposition of teeth enables the jaw to accommodate to a variety of widths of rope and also provides very positive gripping of that rope without however resistance to it being stripped when desired.

The disclosure also includes a novel arrangement of stripper tongue and line guide in which the stripper tongue is provided on a stationary slip ring which forms the base of the tailing channel and where the line guide entraps an end portion of the tongue and may be radially supported by it. An embodiment is also disclosed in which a radially outermost part of the self-tailing jaws are formed for the reception of chain links in the channel, the inner part remaining available for the tailing of line.

17 Claims, 15 Drawing Figures

WINCH

FIELD OF THE INVENTION

This invention relates to winches and in particular to the type of winch known as a self-tailing winch.

BACKGROUND OF THE INVENTION

The development of self-tailing winches over the last few years has been rapid. Characteristically a winch drum has adjacent one end a tailing channel. After line has been wound a few turns around the winch drum it is placed in the tailing channel. When the winch is first operated the tailing channel grips the line thereby enabling, once tension comes on the line, a firm coil of rope to be set up on the winch drum which thereupon takes up the majority of the driving load by frictional interaction with the line.

An example of such a construction is seen in U.S. Pat. No. 3,968,953 of Guangorena.

It will be seen that there are in general two problems with this type of construction. Firstly, there is the problem of accommodating the channel to receiving a range of thicknesses of line, which may be required to be handled by a given model of winch. In the U.S. Patent mentioned above an attempt has been made to meet this problem by spring-loading the jaws so that they can move apart. The degree of movement will depend partly on the pull being exerted on the line and partly in accordance with the diameter of that line. However, apart from the complexity of construction which is involved, it is essential to set the springs correctly. An excessive spring pressure will cause rejection of the line or, if it is received, difficulty in tripping from the jaw; and a weak spring pressure will mean not enough pulling action is exerted on the line.

Most self-tailing channels designed so far have had teeth in the form of ridges or ribs on both of the jaws which define the channel and these have always been opposed directly to each other. The teeth are regarded as compressive and gripping in their action, exerting a squeezing effect of the rope and they are frequently unidirectional so as that there is a greater resistance to slippage of the line in one tangential direction than in the other tangential direction.

The concept in the prior art of wedging the line between opposed jaws (with or without springs on the jaws) means that the degree to which the line is wedged is very largely although not entirely independent of the load to which the line is being subjected. There is a slight degree of dependence because clearly if a very strong load is imposed on the line it will tend to get squeezed further in between the coverging jaws.

In U.S. Pat. No. 3,968,953 one of the jaws is without teeth, being a smooth plate. This expedient has also been adopted (in a different construction and for a different reason) in our co-pending U.S. application Ser. No. 797,251 filed 16th May 1977.

However, even in the type of construction where one of the jaws is without teeth the basic object of the jaws remains that the smooth jaw will provide a reaction surface between which and the toothed jaw the line is to be compressed and thereby gripped by the teeth of the toothed jaw.

Lastly in the pricr art there have been examples of pulley-like devices, see for example Newell U.S. Pat. No. 3,343,809, where the jaws of a line or chain pulling device have been mutually shaped and adapted so as to conform them more or less exactly to the configuration of the line or chain being received in them. The object of such constructions is to achieve an entirely positive, sprocket-like, drive between the line or chain and the pulley upon which it acts. These are not self-tailing devices and the underlying intention is not that the "teeth" shall be staggered but rather that the conformation of each jaw shall complement that of the other in such a way as to adapt to the configuration of the line or chain. Positive drive will not be achieved unless the correct line or chain is used with the device.

SUMMARY OF THE INVENTION

The present invention has the object of providing a self-tailing winch in which the tailing channel has the capacity of receiving line of a predetermined range of diameters without necessarily spring loading the jaws so that they are mutually movable in an axial direction and, most importantly, while permitting whatever the diameter of the line within that range that the line shall be easily stripped from the channel.

In the present invention the teeth of the jaws are staggered i.e. the tooth on one jaw is not circumferentially opposed to the tooth on the other jaw. The line is waved between the alternating teeth and it is the amplitude of the wave which adjusts itself according to the degree of tension being experienced by the line. When this tension is exerted the action of the teeth is such that a considerable tangential force is exerted on the line and at the same time it is urged radially inwardly because of the skew disposition of the teeth.

It is an object of the present invention to provide a self-tailing winch in which, when a high tensile force is exerted on a line received in the self-tailing channel a wave imposed upon the line by the channel tends to be straightened such that the line urges itself into stronger engagement with skewed drive teeth in the form of ridges or ribs on the jaws.

It can be seen that the teeth of the present invention can in many ways be regarded merely as deforming surfaces which impose a waved conformation on the line within the channel rather than has normally been done to regard teeth in such channels as grasping and compressing the line.

It is also an object of the present invention to provide a self-tailing winch in which the disposition of the teeth in the jaws of the self-tailing channel permits ready stripping of the line whatever its diameter within the permitted range, without necessarily spring-loading the jaws and whatever the tension load which is being experienced by the line.

DESCRIPTION OF THE DRAWINGS

Embodiments of the invention will be particularly described with reference to the accompanying drawings wherein:

FIG. 1, FIGS. 3 and 4 show respectively arrangements of teeth not within the invention and within the invention.

DESCRIPTION OF PARTICULAR EMBODIMENTS

Figure 5:
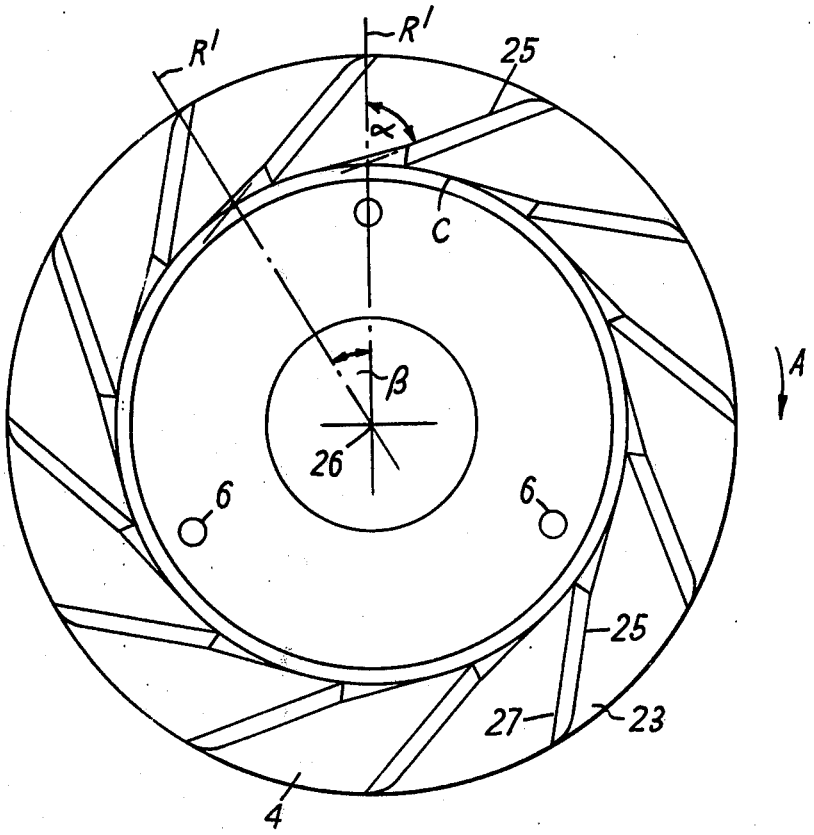
FIGS. 5 and 6 are respectively face views of lower and upper jaws of the self tailing channel of the embodiment.
Figure 6:
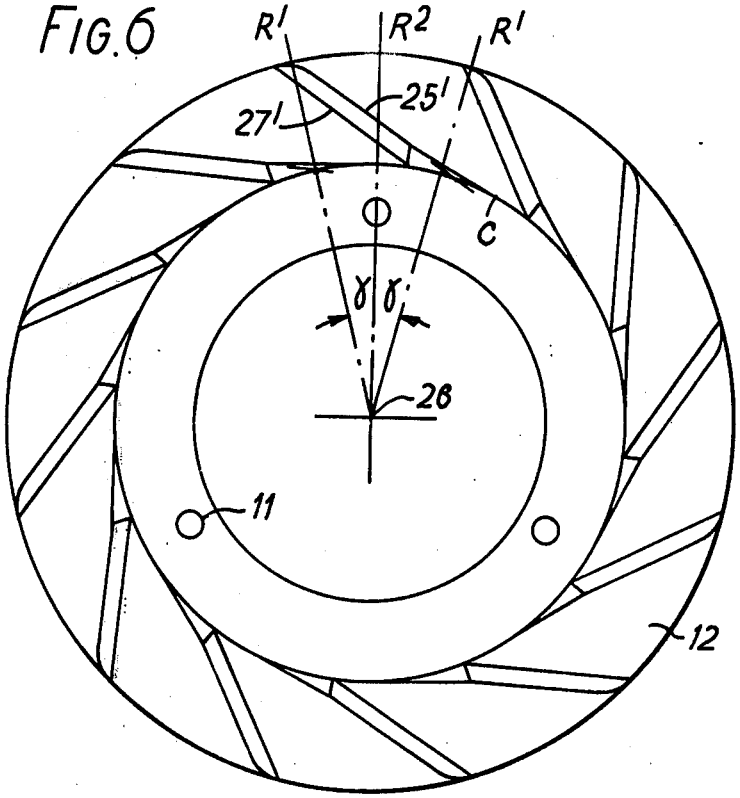
Figure 14:
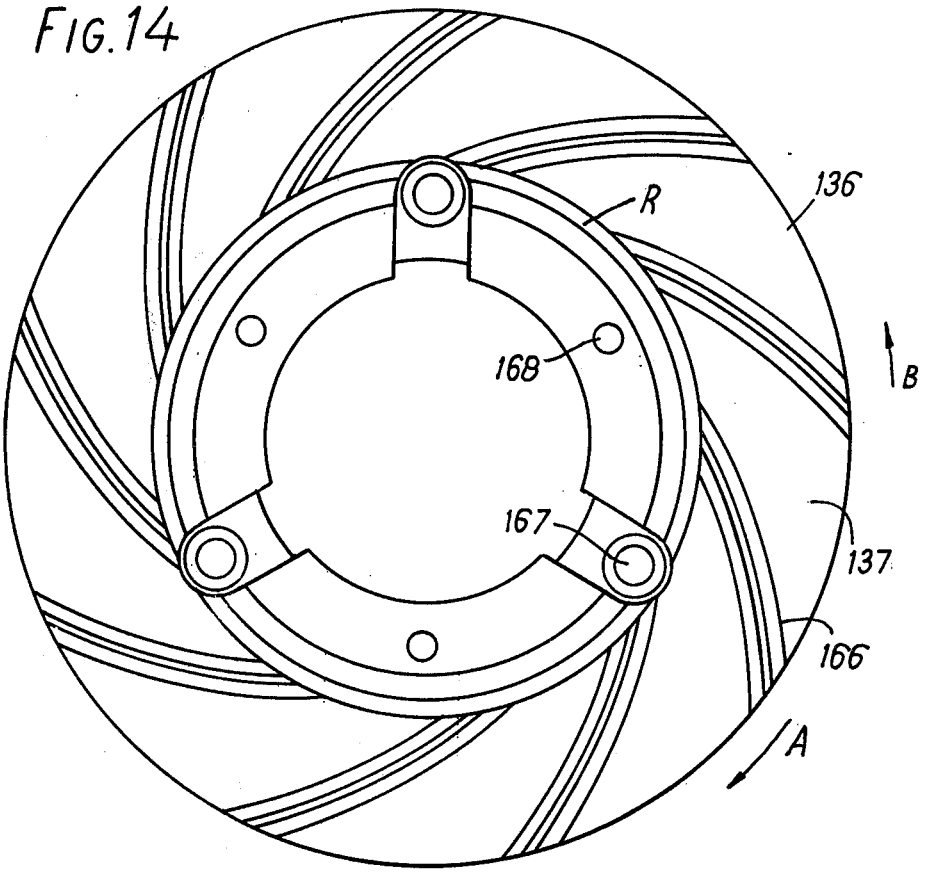
FIG. 14 is a face view of a jaw of the channel as an alternative, in either embodiment, to those of FIGS. 5 and 6

A first embodiment to be described is at the present time a generally preferred embodiment, although the tooth form seen in FIG. 14 is an alternative, advantageous in many respects, to that seen in FIGS. 5 and 6.

Figure 1:
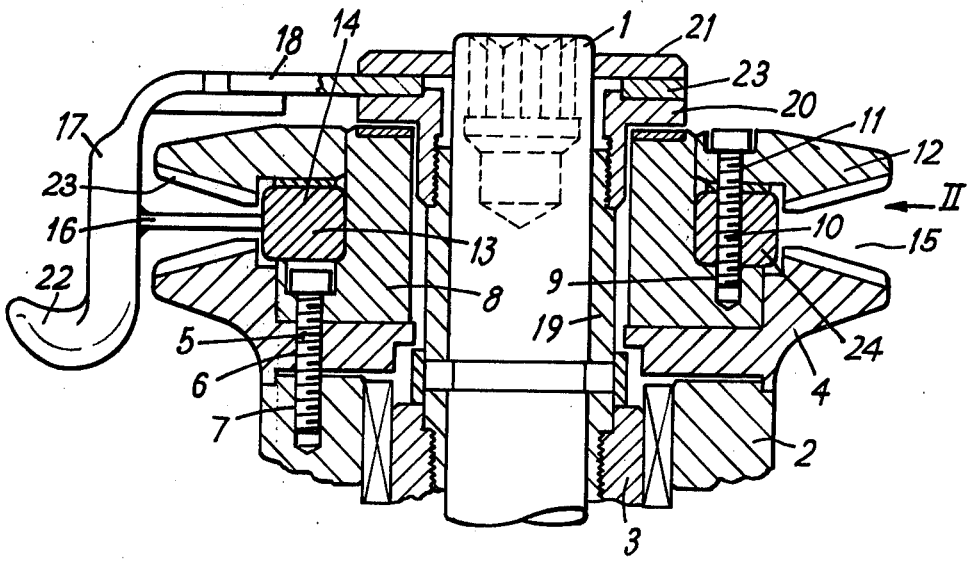
FIG. 1 is a diametrical section through the upper part of a first embodiment of winch.

The winch seen in FIG. 1 is in its lower part of conventional construction containing one or more conventional drive trains for transferring drive from a central main drive shaft 1 to a winch drum 2. Also, a cylindrical sleeve 3 has a conventional flange means for securing the winch as a whole to a deck or the like.

Fast to the upper end of the winch drum 2 is a lower crown plate 4 secured to the drum by three bolts 5 (only one of which is shown) in FIG. 1 passing respectively through three equally circumferentially spaced holes 6 (again only one is shown in this Figure) in the plate 4 to engage threaded bores 7 in the top edge of the drum 2. The bolts 5 also engage to the drum 2 a flanged sleeve 8 in which are three threaded bores 9, also equally spaced circumferentially around the axis 26 of the shaft 1, threaded bores 9 only one of which is shown. These are for respective engagement by three bolts 10 (again only one being shown) which respectively pass through equally spaced holes 11 in an upper crown plate 12. The crown plates 4 and 12 are spaced apart by spacer ring 13 and shims 14 which are penetrated by the bolts 11. Thus a construction is built up which, between the upper and lower crown plates 12 and 4 offers a channel 15 for the reception of line coming from the main winch drum 2.

Because the channel has the function of retaining line within it, it is provided (as is conventional for such channels) with a stripper 16 which projects into it from a reinforced downwardly depending bar 17 angled from a radial arm 18. The arm 18 is secured fast to the stationary sleeve structure 3 through a secondary sleeve 19, a flanged plate 20 which screw-threadedly engages the sleeve 19 and a top cap 21 penetrated by bolts engaging through apertures in an annular root 23 of the arm 18 to the plate 20. At the lowermost end of the downwardly depending bar 17 is a line guide 22 in the form of an upwardly inclined channel or scoop so that line is guided upwardly at an angle when it passes from the main drum 2 to within the channel 15. Line passes through nearly 360° within the channel and is stripped out of it by coming up against the asymptotic front face of the stripper 16 which lies at a shallow angle to the base 24 of the channel defined by the radially outer face of the ring 13. The functions of the stripper and the line guide are per se known.

To cause positive frictional engagement between the plates 4 and 12 and line lying within the channel 15 those plates have teeth lying in respective frustoconical envelopes indicated at 23 and which will be described in detail with reference to the remaining Figures. Because of the coincity of the faces of the plates which bear the teeth, the channel 15 becomes axially narrower as it approaches its base 24. Best results are achieved when the total angle included between these faces is in the range 20°–38°, inclusive (i.e. the face of each plate has an angle of conicity of 80° to 71°), especially when the total included angle is about 25°.

Figure 2:
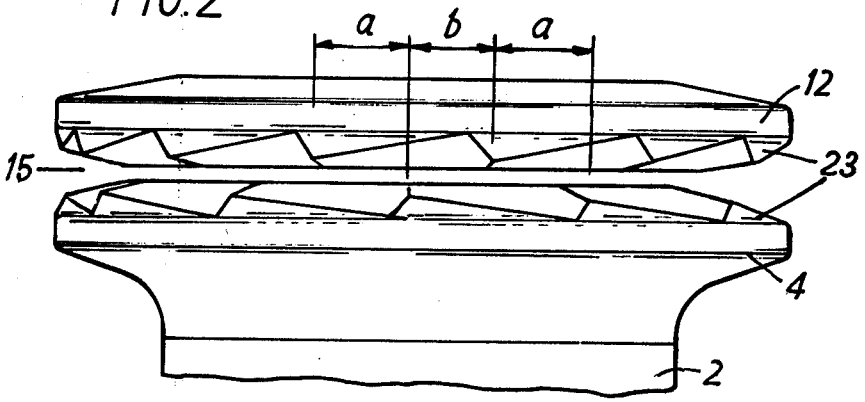
FIG. 2 is a side elevation of the winch on the line of arrow II
Figure 3:
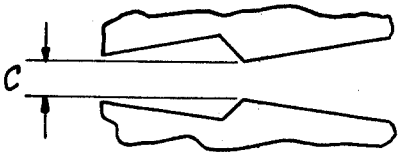
Figure 4:
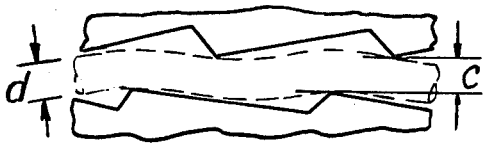

In FIG. 2 the teeth generally indicated at 23 are seen to be off-set as between the teeth on the lower plate 4 and the teeth on the upper plate 12. The developed pitch of the teeth on each plate is equal to the distance a plus b. However the plates are circumferentially (angularly) offset so that teeth of the lower plate 4 come in a vertical line part way, and preferably half-way, between the vertical lines containing the teeth of the upper plate that is to say preferably, and as shown, the distance a in FIG. 2 equals the distance b. The reason for this arrangement is that in this manner plates of given diameter, angle of conicity and tooth depth have a greater capacity for line of different thickness than would be the case if the teeth were arranged in the obvious fashion which is with the peaks of the teeth directly opposed to each other. FIG. 3 shows the position when the peaks of teeth are opposed to each other, as in the prior art. The clearance between those teeth at any particular radius within the channel can be represented by the distance c. That is to say that is the maximum diameter of line which can be accepted by those teeth at that radius without damage to the line or jamming. However if the teeth are offset as seen in FIG. 4 although vertical clearance between teeth, i.e. the distance c is the same, because the line can adopt the wavy conformation seen in dotted lines, the line may have a diameter d which is greater than the distance c. The conformation adopted by a line that lies within the channel 15 is therefore a function of the radial position it adopts within the channel of its diameter and of the tension exerted on it. A narrow line will lie comparatively straight between the teeth at a comparatively small radius around the central axis of the winch. A thick line under the same load would adopt a waved conformation at comparatively a larger radius. Thus, for a given fixed construction of winch a larger range of lines may successfully be handled than would have been the case without the offset tooth arrangement which is proposed in the present invention.

Furthermore, it can be seen that, for a given line in a given channel, its waviness imposed by the alternating teeth is a function of the tension it is subject to. Increase in tension will tend to urge the line radially inwards, decreasing distance at which teeth alternately from the two jaws act on it. The wavelength of the wave conformation of the line between the jaws decreases so that the angle through which the line bends round each tooth increases thereby giving increased driving effect of that tooth on the line. This concept of drive being derived from the bending of the line alternately round alternating staggered teeth results also in a remarkable ease of stripping. This is because the tailing channel does not depend for its driving effect on mechanical compression of the line between opposed teeth.

Tooth shapes and sections which are particularly suitable are shown with reference to the FIGS. 5 to 8 and 14.

In FIGS. 5 and 6 there are shown respectively lower and upper crown plates 4 and 12 in their face view. Dealing first with the lower plate, the three holes 6 are seen and it is seen also that these are on the same radius as the root from which the crest 25 of a tooth 23 is generated. The roots from which the crests are generated lie on a circle C which should be of a radius at least as great as that of the winch drum. The line of the crest 25 is such that it subtends an angle $\alpha$ with the radius which passes from the central axis 26 of the winch through the radially innermost point of that crest, which radius is indicated in FIG. 5 at R1. The angel a in this case is $\alpha$ . For a twelve tooth plate, the angle subtended at the axis 26 between adjacent radii R1 will be 30°, this being the angle $\beta$, with the root end of a given tooth lying on a common radius with the marginal (outer) end of a next adjacent tooth. The angles $\alpha$ and $\beta$ will depend on the number of teeth provided in each jaw and the relation between the root-line radius and the outer marginal radius of the teeth (i.e. the radial width of the jaw). The construction of the plate 12 is very similar except that the three holes 11 on that plate are positioned equi-distantly between the innermost ends of teeth crests 25'. That is to say the radius R2 passing centrally through each hole 11 from the axle 26 subtends equal angles $\alpha$ at that axis with two adjacent radii R1.

Figure 7:
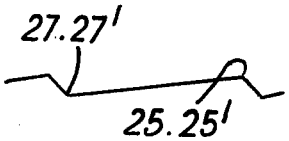
FIG. 7 shows the profile of the teeth on these plates.

A suitable tooth conformation for both plates is seen in FIG. 7, with the leading face on either plate being set at an angle of 45° to an axial plane and the rear face or trailing face of the tooth being blended back from the rounded crest line 25,25' to the base of the adjacent tooth, seen on the drawings at 27,27'.

Figure 8:
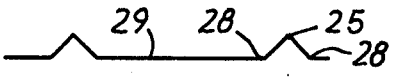
FIG. 8 is a profile of an alternative form of tooth.

In an alternative construction seen in FIG. 8 the teeth are given the form, seen in cross-section, of right angles 45° triangles having a crest 25 and rising at leading and trailing roots 27 from a flat base 29.

An alternative tooth shape for this embodiment and indeed one which is preferred is that seen in FIG. 14, which will be described later.

Figure 9:
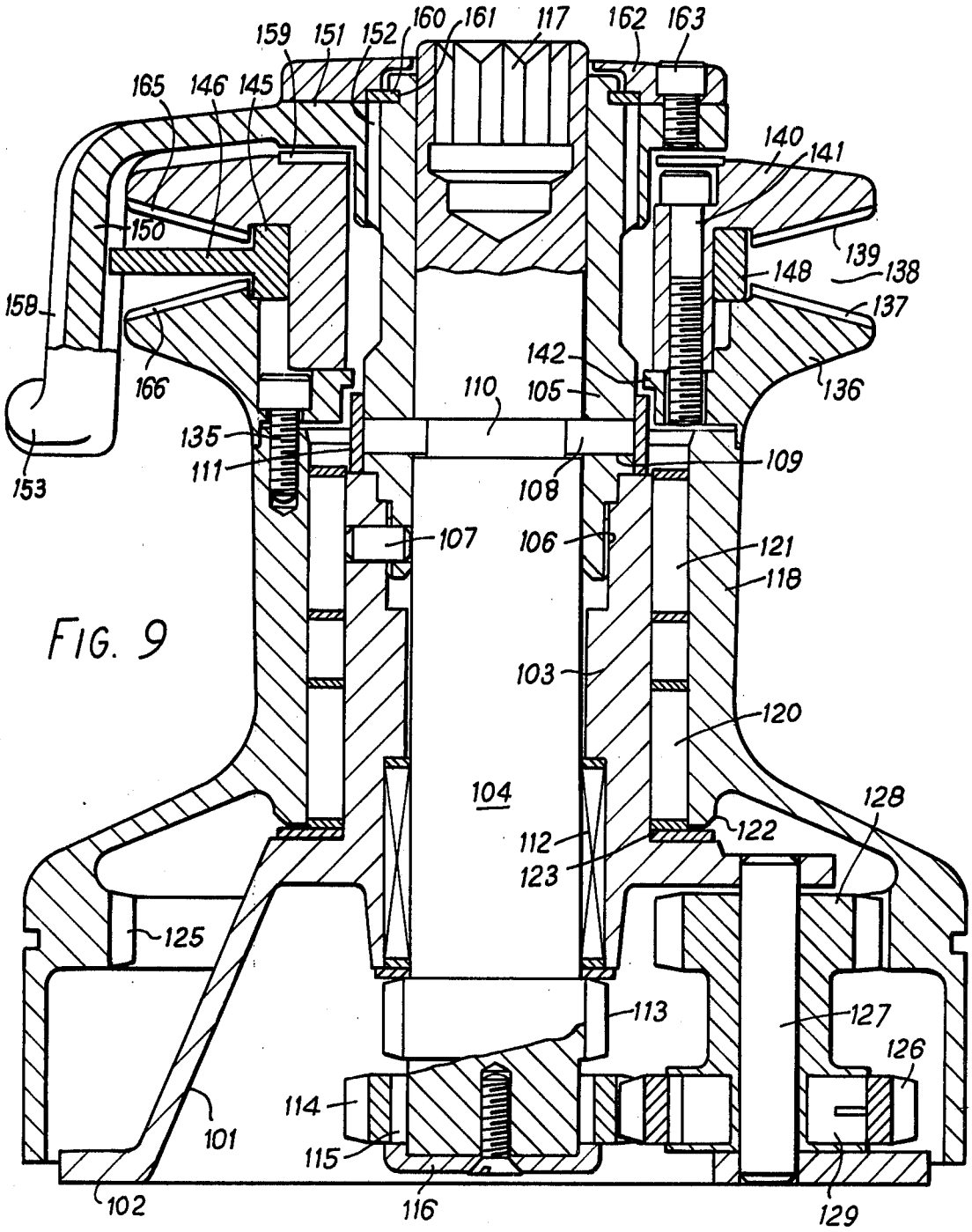
FIG. 9 is a diametrical section through a second embodiment.

In a second embodiment, the manually powered self-tailing winch seen in FIG. 9 has a stationary core structure which is indicated at 100 including a flanged part 102 for bolting to the deck or the like of a yacht and a sleeve part 103 which surrounds a central end rotatable drive shaft 104. A further part of the stationary core structure is a sleeve 105 which is threaded at 106 to an upper part of the sleeve 103 and pinned axially to it by pin 107. The shaft 104 is held axially in position by keys 108 in the core part 105 which penetrate through apertures 109 in that part and engage in a groove 110 in the shaft, these keys being held radially in position by a keeper band 111. An anti-friction rolling bearing 112 is provided near the base of the sleeve 103 for supporting the shaft 104 and at its root the shaft is provided with pinions 113 and 114, teeth of pinion 113 being formed in the material of the shaft and those of 114 being provided by a pinion ring splined onto the shaft at 115 and held in position by a screwed-on end cap 116.

Drive may be transmitted to the main drive shaft 104 by the engagement of a shaft of a handle (not shown) in a polygonal section blind bore 117 at the head of the winch. A winch drum 118 is supported about the outer surface of the sleeve 103 by a pair of rolling contact bearings 120,121. Downward motion of the drum 118 is delimited by the abutment of a rib 122 on the internal surface of the drum against a friction washer 123 borne on a flange projecting outwardly from the bottom of the sleeve 103. The drum also has on its internal surface geared teeth 125.

Figure 10:
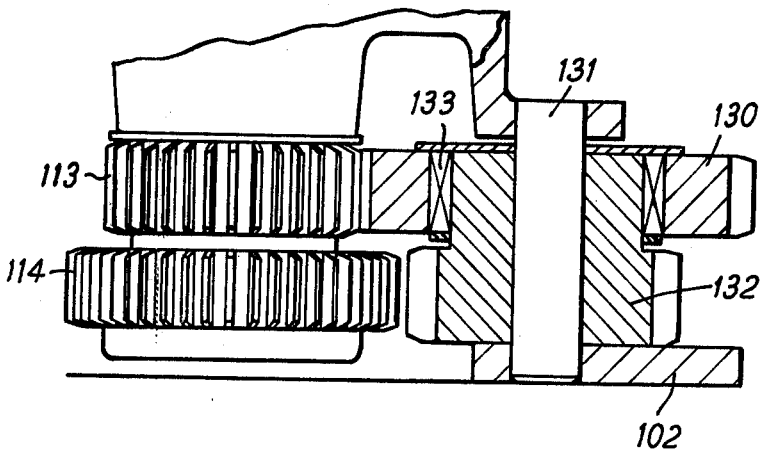
FIG. 10 is a radial and partial section taken at an angle to FIG. 9 to show a second gear train, FIG. 11 has on the right hand side a radial section and on the left hand side an elevation of an end plate, line guide arm and line guide.

Gear trains between the drive shaft 104 and the gear teeth 125 are a conventional two-speed automatic change arrangement, pinion 114 meshing with pinion 126 on a first stub shaft 127, which bears also pinion 128 meshing with the teeth 125. Pinion 126 is linked to the teeth 128 through a pawl and ratchet mechanism 129. Pinion 113 meanwhile engages (see FIG. 10) with pinion 130 on a second stub shaft 131 which bears also pinion 132 which meshes with pinion 126 on the stub shaft 127. Unidirectional drive 133 is effective between the pinion 130 and the teeth 132. The arrangement of these gears and of the directionality of the unidirectional drives is in itself conventional and is such that winding of the main drive shaft firstly in one direction and then in the other will cause drive to be transmitted to the drum firstly in one ratio and then in another (through gear trains 114,126,128,125 and 113,130,132,126,128,125 respectively) with the drum continuously driven in only one direction but at those two different ratios.

A lower plate 136 is bolted to the uppermost end of the drum by three bolts 135 only one of which can be seen in FIG. 9. The lower plate 136 offers a lower annular jaw 137 of a self tailing channel 138. The upper jaw 139 of this channel is offered by an upper plate 140 which is secured fast to the lower jaw 137 of three bolts 141, again only one being seen in FIG. 9.

It can be seen that because of bolting of the lower jaw to the drum and of the upper jaw to the lower jaw both jaws 136 and 140 necessarily rotate at all times together and are rotating with the drum.

Lower jaw 136 has an inwardly projecting ridge 142 which abuts over the top of the keeper band 111 and prevents its upward escape.

Each of the jaws 37,139 is frustoconical and has teeth which are staggered as across the channel in a manner which has been described in connection with the first embodiment. The conformation of the teeth may be as seen in FIGS. 5 to 8 or as in FIG. 14, to be discussed in more detail later.

At the base of the channel 138 formed by the jaws each of the plates 136 and 140 is undercut to offer a housing for a ring 145 of essentially rectangular section (preferably with rounded corners) which is entrapped between those jaws and is in sliding contact with them both at its radially inward cylindrical surface and at its top and bottom planar annular surfaces. These contact surfaces of the ring are preferably coated with a low friction coating material such as polyetrafluoethylene. A stripper tongue 146 is integrally formed with the ring and projects outwardly at the middle of the channel 138 to beyond the outermost radius of the channel. The tongue 146 is (FIG. 13) a symmetrical construction such that the whole of the ring and tongue is symmetrical about the plane through the line P FIG. 13, the tongue having two equally inclined edges faces 147 one of which will act as a stripping surface for line travelling round the stripping channel 148 under the influence of the jaws 137,139.

It is seen that both jaws 137,139 are rotating but the stripper tongue 146 must necessarily be stationary if it is to be effective. Since the tongue and ring are integral the base surface 148 of the channel is also stationary. To achieve this, a stationary line guide arm 150 is provided integrally with a top plate 151 of the winch which is splined at 152 to the upper stationary core part 105 so as to prevent rotation of that plate. The line guide arm 150 projects axially downwardly over the channel 138 to be generally parallel to the axis of the main shaft 14 and has at its bottom an outturned, trough or spoon-like line guide 53 for the reception and guidance of line transferring from the drum the self tailing channel.

Figure 13:
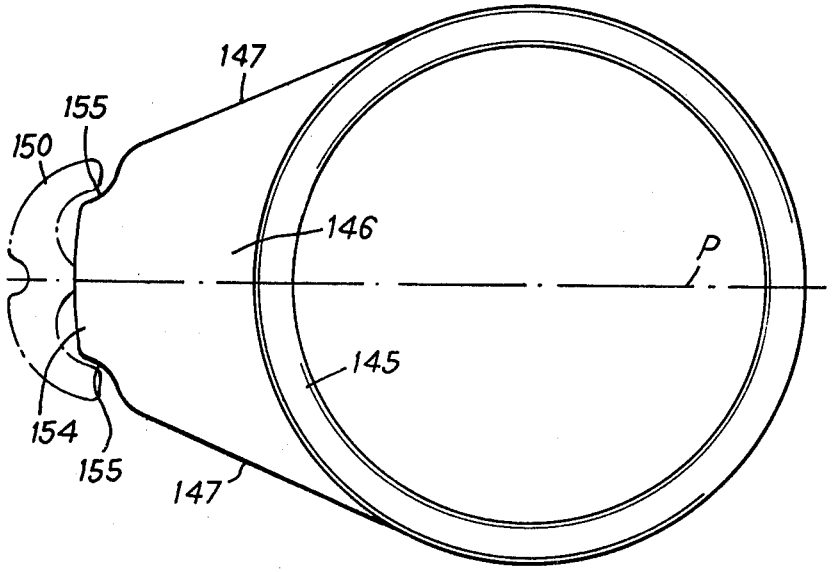
FIG. 13 is a plan view of a stripper tongue and ring.
Figure 11:
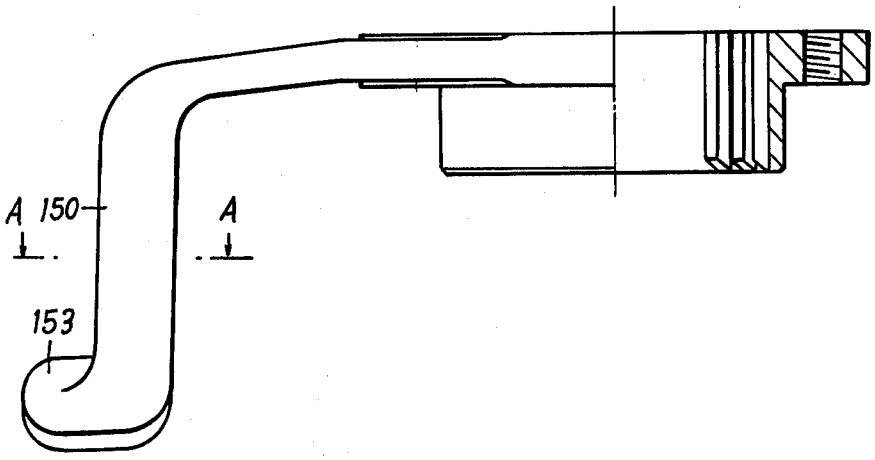
Figure 12:
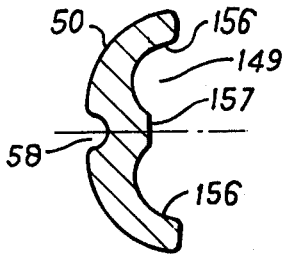
FIG. 12 is a section on the line A—A FIG. 11.

As is seen in FIGS. 12 and 13 the line guide arm 150 has an inner surface which is generally concave towards the radially inner side so as to offer a channel 149 to that side. This channel receives a projecting end nose 154 of the stripper tongue 146. This end nose has flank surfaces 155 which upon a tendency of the tongue to rotate will abut against flank surfaces 156 of the line guide arm 150.

At the centre of the channel 149 of the radially inner side of the line guide arm 150 is an inwardly projecting rib 157 which in a normal condition of the line guide arm will be just radially clear of contact with the nose 154 of the stripper tongue. A groove 158 runs along the radially outer face of the line guide arm 150.

A washer 159 is borne on an upper face of the upper plate 140 to provide axial restraint of the whole of the drum and upper and lower plate assembly by abutment against an underface of the top plate 151. The top plate 151 is held axially onto the core part 105 by a split collet 160 engaging a groove 161 in that part, the collets 160 being held entrapped by the fitting of an annular plate 162 screwed securely to the top plate 152 by bolts 163.

The teeth 165 on the upper jaw 139 and 166 on the lower jaw 137 are staggered as across the channel preferably being offset by half their pitch. FIG. 14 is a top plan view of the lower jaw plate, the direction of pulling rotation being indicated by arrow A. Teeth 166 are trapezoidal section ridges and extend in an arc centered approximately on the radius R at which the teeth end at the radially innermost edge of the jaw 137 and which is itself of a substantially greater radius r. The value of r/R is about 1.75. Preferred values lie in the range from about 1.50 to about 2.00. The effect and function of such teeth is the same as that described above though they offer rather improved ease of removal of line by virtue of their arcuate shape and skew.

Curved skew teeth do not necessarily have a single curvature - they may have compound curvature with differing radii of curvature - and the direction of skew is not necessarily that shown, for example the skew could be as if the intended direction of rotation were to be that indicated by arrow B, FIG. 14.

FIG. 14 additionally shows bolt holes 167 for the reception of bolts 135 and screwthreaded bores 168 for the reception of bolts 141.

The upper plate 140 has similar teeth upon its jaw surfaces 139 with teeth 165 circumferentially disposed mid-way between adjacent and lower teeth 166 so that the teeth are staggered.

It can be seen that assembly of the second embodiment of winch is particularly simple involving a simple building upwards from the base of the winch with parts being successively held and positioned by the assembly to the winch of subsequent parts. In particular the insertion and securing of the stripper tongue with its ring and of the plate 151 with its line guide arm 150 is simplified since the ring 145 is merely sandwiched between the lower and upper plates 136, 140 before they are secured together by bolts 141 the top plate 151 then being fitted onto the splined end 152 of the core part 105 while simply ensuring that the part 154 of the stripper tongue will enter into the channel 149.

Figure 15:
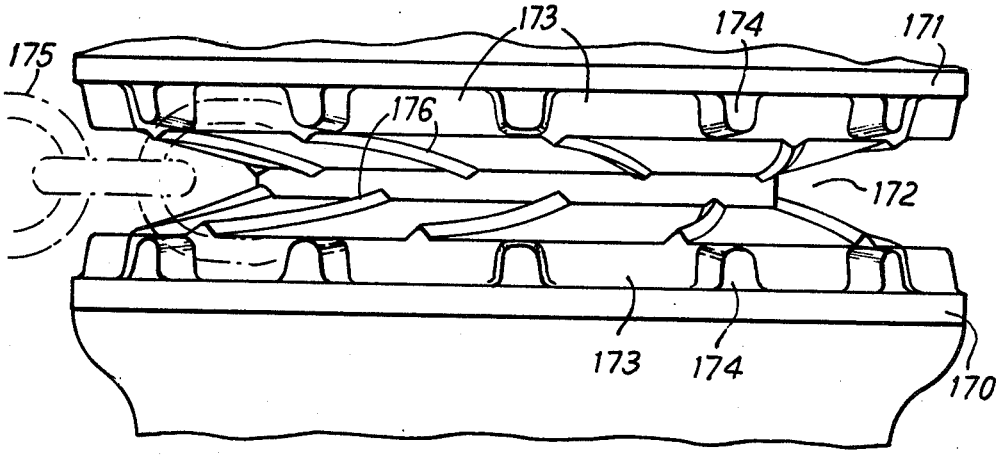
FIG. 15 is a side view of a modified embodiment.

In a modification seen in FIG. 15, the self-tailing channel is adapted to allow the winch to be used also for hauling chain. A radially outermost part of both the jaws 170,171 defining the channel 172 which in itself is as previously described formed with indentations 173 and lugs 174. The indentations 173 complement each other in forming the conformation of a chain 175. Such a chain can then be engaged and driven by the winch as in the prior art chainpulling devices acknowledged at the beginning of this specification. The contrast between the directly-opposed chain-engaging indentations and their sprocket-like action on a chain and the staggered teeth 176 (as for the first or second embodiments) provided at a radially inner part of the jaws, both in terms of nature and function, is very clearly shown in this modified embodiment.

We claim:

1. In a self-tailing channel of a manually powered winch including a pair of annular jaws defining side walls of the channel for the reception of a line to be tailed, there being line-engaging teeth in each said jaw, and means for rotating said jaws about an axis of rotation, the improvement comprising the teeth on one of said jaws being offset from and staggered relative to the teeth on the other of said jaws, and extending in an annular endless array about said axis of rotation for imposing upon line between them a wave-form deriving from alternating contact with the teeth of the jaws, respectively, whereby the wave-form is a function of the line size and tension experienced by the line and the line may be readily stripped from the channel.

2. The improvement as claimed in claim 1 wherein the teeth on each jaw are skewed relative to the radial direction of each jaw.

3. The improvement as claimed in claim 2 wherein the teeth on each jaw are straight.

4. The improvement as claimed in claim 3 wherein the teeth extend from an end lying on an inner circular root-line to an end lying on a circular outer marginal line, the root end of the given tooth and the marginal end of a next adjacent tooth lying on a common radius.

5. The improvement as claimed in claim 2 wherein the teeth on each jaw are arcs of circles generated from a circular root line on which radially inner ends of the teeth lie.

6. The improvement as claimed in claim 5 wherein the ratio between the radius of the circular root line and the radius of the said arcs is from about 1.5 to about 2.

7. The improvement as claimed in claim 5 wherein the ratio between the radius of the circular root line and the radius of the said arcs is about 1.75.

8. The improvement as claimed in claim 2 wherein each jaw is conical, with the total included angle between the faces being between about 20° and 38°.

9. The improvement as claimed in claim 1 wherein the teeth are offset by half the distance between adjacent teeth.

10. A winch as in claim 1, wherein the jaws are fixedly maintained at a predetermined spacing in the axial direction.

11. A manually powered winch with a winch drum and a self-tailing channel adjacent to and coaxial with the drum for rotation about an axis, the channel being defined by a pair of conical, annular jaws, teeth on each said jaw, and extending in an annular endless array about said axis of rotation, the teeth on one jaws projecting axially towards the other jaw across the channel, the teeth on one jaw being staggered relative to the teeth on the other jaw so that teeth are offset from each other across the jaw, the teeth on each jaw being skewed whereby to exert a high tangential and low radially inward force on line engaged by the channel for self tailing, the line being wavingly deformed by the said staggered teeth to provide said self tailing traction on any line within a predetermined range of line sizes and to permit ready stripping of the line from said channel, whatever the tension load experienced by the line.

12. A winch as claimed in claim 11 wherein the teeth on each jaw are straight and extend from an end lying on an inner circular root line to an end lying on a circular outer marginal line, the root end of a given tooth and the marginal end of a next adjacent tooth lying on a common radius.

13. A winch as claimed in claim 11 wherein the teeth on each jaw are arcs of circles generated from a circular rootline on which radially inner ends of the teeth lie, the ratio between the radius of the circular root line and the radius of the said arcs is from about 1.5 to about 2.

14. A winch as in claim 11, wherein the jaws are fixedly maintained at a predetermined spacing in the axial direction.

15. A manually powered winch with a winch drum and a self-tailing channel adjacent to and coaxial with the drum for rotation about an axis, the channel being defined by a pair of conical, annular jaws, teeth on each said jaw, the teeth on one jaw projecting axially towards the other jaw across the channel, and extending in an annular endless array about said axis of rotation, the teeth on one jaw being staggered relative to the teeth on the other jaw so that teeth are offset from each other across the jaw for engaging line between the jaws on alternate sides at a radius on the jaws dependent on the thickness of the line and the tension experienced by it there, whereby to permit ready stripping of the line from said channel, whatever the tension load experienced by the line, further including a member defining a base of the channel, a stripper tongue projecting radially outwardly from the member between the sides of the channel, a line guide support member radially outside the channel and extending axially across it, a line guide at one end of said support member, means for securing the said support member stationary to an end of the winch, and engagement means between the support member and the stripper tongue for engaging the stripper tongue to the stationary support member to prevent rotation of the tongue and the base member.

16. A winch according to claim 15 wherein the engagement means incudes a radially outwardly projecting groove in a radially inner face of the support member and a nose on said tongue projecting radially into the said groove.

17. A winch as in claim 15, wherein the jaws are fixedly maintained at a predetermined spacing in the axial direction.

* * * * *